United States Patent [19]

Wolf

[11] Patent Number: 4,573,936

[45] Date of Patent: Mar. 4, 1986

[54] DRIVING TOY

[76] Inventor: Tobin Wolf, 285 Aycrigg Ave., Passaic, N.J. 07006

[21] Appl. No.: 538,543

[22] Filed: Oct. 3, 1983

[51] Int. Cl.[4] ..... A63H 17/14

[52] U.S. Cl. ..... 446/7; 446/135; 446/451; 446/454; 272/31 R

[58] Field of Search ..... 446/7, 133, 134, 135, 446/136, 450, 451, 454; 273/1 GA, 1 GB, 86 C, 86 F, 86 H; 434/63; 272/31 R, 31 A, 31 B

[56] References Cited

U.S. PATENT DOCUMENTS

| | | | |
|---|---|---|---|
| 1,532,595 | 4/1925 | McMannis | 272/31 R |
| 1,942,514 | 1/1934 | Mayer | 272/31 R |
| 2,792,224 | 5/1957 | White | 272/31 R |
| 2,901,251 | 8/1959 | Pettit | 272/31 B |
| 3,525,175 | 8/1970 | Wolf | 446/136 |
| 3,657,457 | 4/1972 | Poynter | 446/7 |
| 3,984,105 | 10/1976 | Breslow | 446/450 |

FOREIGN PATENT DOCUMENTS

| | | | |
|---|---|---|---|
| 949366 | 2/1949 | France | 272/31 A |
| 1081483 | 6/1954 | France | 272/31 A |
| 1123908 | 6/1956 | France | 272/31 R |

*Primary Examiner*—F. Barry Shay

*Attorney, Agent, or Firm*—Jay M. Cantor

[57] ABSTRACT

A toy wherein remote objects are moved in response to the rotation of a steering wheel. A first embodiment has a pulley keyed to the shaft of the steering wheel, a second pulley journaled in the base of the toy and a belt therebetween. A drive arm arranged to snap into a slot on the side of a toy vehicle is affixed to the second pulley whereby its rotation will cause the drive arm and the vehicle to rotate. The drive arm includes a hinged center portion to permit vertical movement of its end in addition to the horizontal movement.

In a second embodiment a ninety degree sector is secured at one apex to the steering wheel shaft, the sector being restrained to rotate only about ninety degrees before being returned to its original position. A rigid link has one end attached to a further apex of the sector and the other to a ratchet arm secured to a center post in the base of the toy. Also secured to the center post for rotation thereon is a ratchet wheel to which the drive arm is fixed. A pawl is secured to the ratchet arm and maintained by a spring in contact with the ratchet wheel. Rotation of the steering wheel in a back and forward direction will cause the link to move the ratchet arm in a forward and rearward direction to in turn rotate the drive arm in one direction.

19 Claims, 7 Drawing Figures

DRIVING TOY

BACKGROUND OF THE INVENTION

1. Field of the Invention

This invention relates to a driving toy, preferably for use by preschool children.

2. Description of the Prior Art

Driving toys are well known in the prior art. Such toys are normally relatively expensive to build due to the large number of parts and expensive components required. In accordance with the present invention, there is provided a driving toy which is of simple construction and which yet provides realistic operation, this being provided by the drive mechanisms provided herein.

SUMMARY OF THE INVENTION

In accordance with the present invention, there is provided a toy, preferably for preschool children, wherein objects are moved in response to the rotation of a steering wheel. In accordance with the first embodiment of the invention, a pulley system is provided wherein a grooved pulley is keyed to the shaft of the steering wheel, a resilient belt or the like engaging the pulley groove. The belt extends to a second grooved pulley journaled in the base of the toy. A drive arm arranged to snap into a slot on the side of the vehicle is affixed to the second pulley whereby rotation of the second pulley will cause the drive arm to rotate along with the vehicle attached thereto. The drive arm includes a hinged center portion to permit vertical movement of the end of the drive arm in addition to the horizontal movement resulting from rotation of the second pulley. In this manner, rotation of the steering wheel will cause rotation of a remote object with capability of vertical movement when passing over humps or the like in the base structure.

In accordance with a second embodiment, a different driving mechanism is provided wherein a ninety degree sector is secured at one apex to the shaft of the steering wheel, the sector being restrained to rotate only about ninety degrees before being returned to its original position. A rigid link is attached to a further apex of the sector at one end and at its other end is connected to a ratchet arm secured to a center post in the base of the toy. Also secured to the center post for rotation thereon is a ratchet member to which the drive arm is secured to rotate therewith. A pawl is secured to the ratchet arm and contacts the ratchet. A spring member maintains the pawl in contact with the ratchet. Rotation of the steering wheel in a back and forward direction will cause the link to move the ratchet arm in a forward and rearward direction. Each forward movement of the ratchet arm will cause the pawl to move the ratchet a distance of one gear tooth with the pawl being returned to its initial position upon reverse rotation of the steering wheel. In this way, continued backward and forward movement of the steering wheel will cause an object attached to the drive arm to rotate in a circle about the post.

Figure 1:
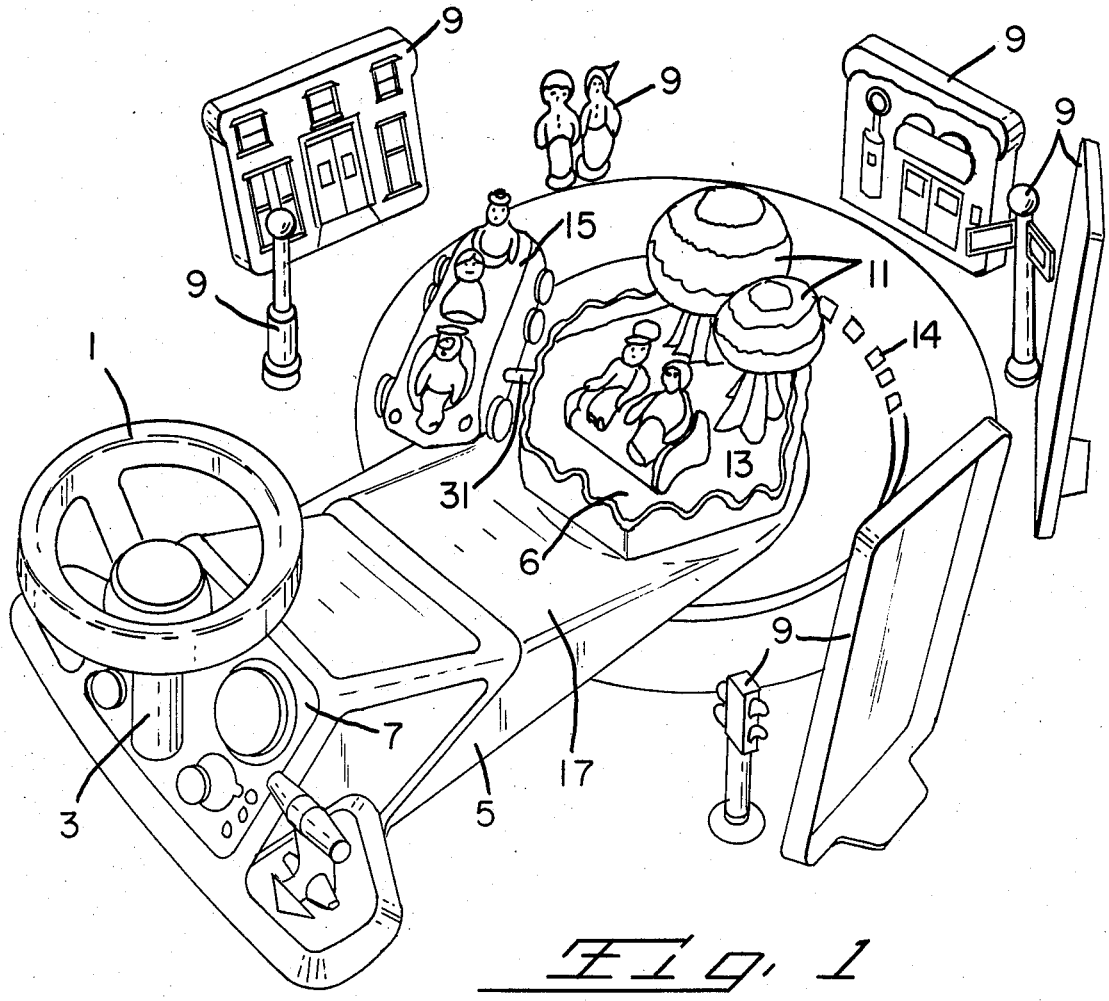
FIG. 1 is a perspective view of a toy using the mechanism in accordance with the present invention.

FIG. *6a* is a cross sectional view of the toy of FIG. 1 from the driven end in accordance with a second embodiment of the invention; and FIG. *6b* is a bottom view of the toy of FIG. 1 from the driven end in accordance with the second embodiment of the invention.

DESCRIPTION OF THE PREFERRED EMBODIMENTS

Referring first to FIG. 1, there is shown an overall view of a preferred embodiment of the drive around toy in accordance with the present invention. The toy includes a steering wheel 1 secured to a shaft 3, the shaft 3 being secured to a member to be described hereinbelow beneath the base 5 which comprises the housing for the toy herein. A dashboard 7 is shown which includes other gauges and the like to provide an aura of realism to the dashboard. Remote from the steering wheel 1 and secured to the base or housing 5 is a village center 6 which is secured to base 5 by screw 69 (see FIG. *6a*). A plurality of movable play pieces 9, these taking the form of buildings, people, lamp posts and the like surround the base 5. The village center 6 which forms a portion of the base is a center region which includes trees 11, a bench 13 with people thereon and a track 14 around the center which can be affixed to the base 5 or a separate movable element. A vehicle 15 is shown on the track at the center region, the vehicle being driven by the mechanism forming a part of the present invention which will be described hereinbelow. The vehicle 15 will travel in a circular path around the trees 11 and the bench 13 and pass over the hump portion 17 forming a part of the base as a portion of its travel path.

Figure 2:
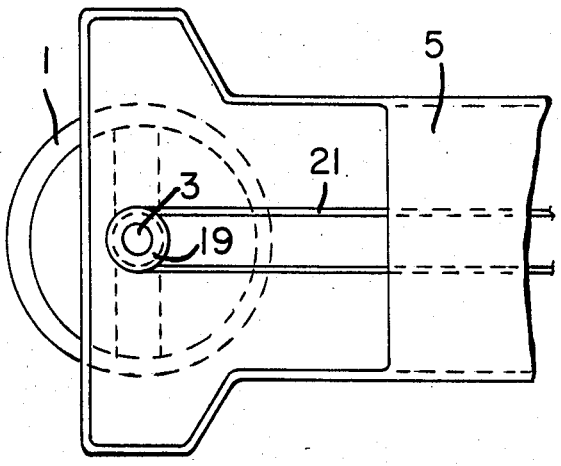
FIG. 2 is a bottom view of the toy of FIG. 1 from the driving end in accordance with a first embodiment of the invention.
Figure 3:
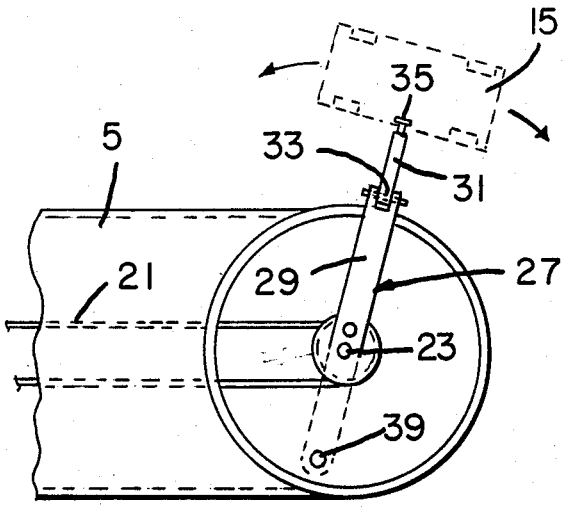
FIG. 3 is a bottom view of the toy of FIG. 1 from the driven end in accordance with the first embodiment of the invention.

Referring now to FIG. 2, there is shown a first embodiment of the drive mechanism for the vehicle 15 of FIG. 1. This mechanism includes a grooved pulley 19 affixed to the steering wheel shaft 3 and having a belt 21 in the groove thereof which passes beneath the base 5 to a center post 23, FIG. 3, disposed at the center of the path of travel of the vehicle 15 to which the base 5 is secured. A grooved pulley 25 is secured to the shaft 23, the other end of the belt 21 being secured within the grooves of said pulley 25. A drive arm 27 (FIGS. 3 and 4) is secured to the pulley 25 for rotation therewith. The drive arm 27 includes a first portion 29 secured to the pulley 25 and a second portion 31 for engagement with a vehicle or the like which is hingedly secured to the portion 29 by means of the hinge 33 to permit movement of the arm portion 31 in a direction normal to the plane of travel of the arm portion 29. This will permit the vehicle 15 to move in an upward direction when traversing the hump portion 17 of the base 5 or any other impediment in its path which requires a vertical movement to pass thereover.

It can be seen that, with rotation of the steering wheel 1, the belt 21 will rotate in either a forward or backward direction, depending upon the direction of rotation of the steering wheel, and cause the pulley 25 and the arm 27 attached thereto to rotate in a circular path to provide rotary movement to the vehicle 15.

Referring again to FIG. 3 there is shown at the other end of arm 27 a magnet 39 remote from the pulley. This magnet can be utilized to drive a further magnetized element, such as a vehicle 68 having a magnet 39' in its base to magnetically couple to magnet 39 as shown in FIG. *6a*, which is disposed thereabove on the other side of the base 5 so that other mechanisms can be driven about the village center.

Figure 4:
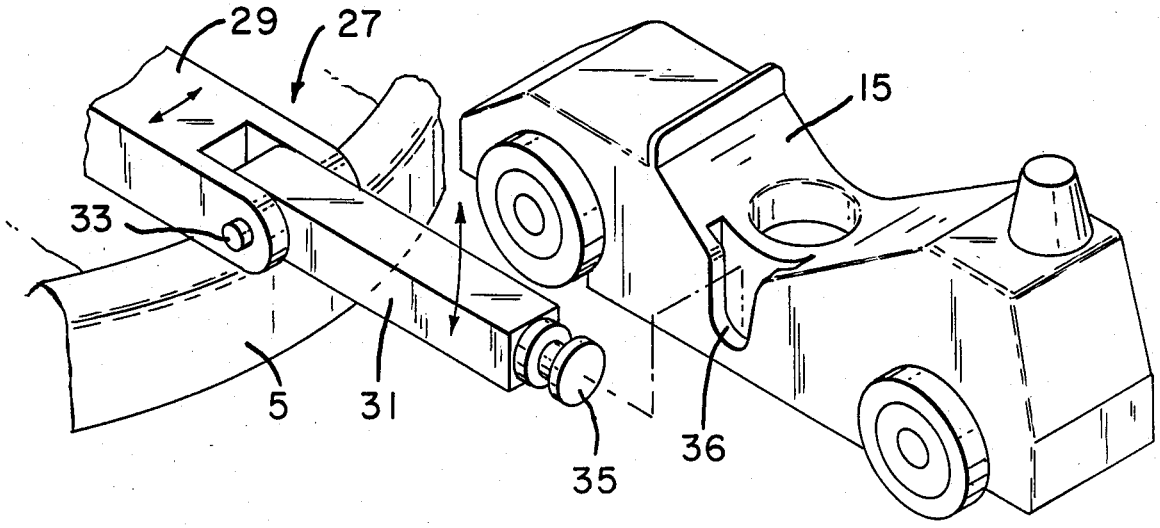
FIG. 4 is an enlarged view of the interconnection between vehicle and driving member.

It should be noted that the arm 31 can have any attachment-type arrangement 35 at its end for securing to the vehicle 15. Preferably, this securing or attaching arrangement is of a removable type so that the operator can readily change the vehicle to be driven by removing one from the end of the arm 31 at 35 and attaching a different one thereto. As shown, the member 35 is releasably lockable in the groove 36 of the vehicle (FIG. 4).

Figure 5:
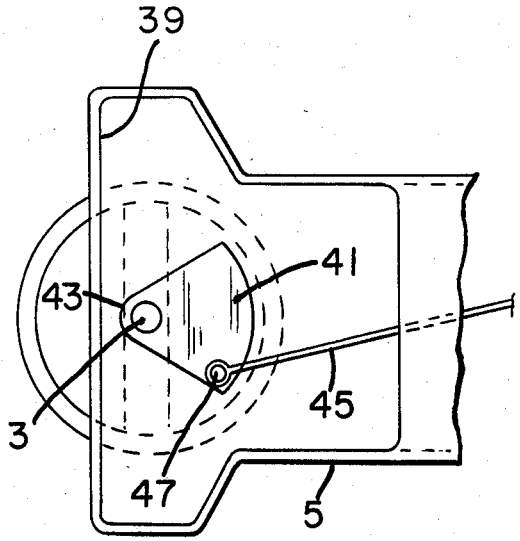
FIG. 5 is a bottom view of the toy of FIG. 1 from the driving end in accordance with a second embodiment of the invention.
Figure 6A:
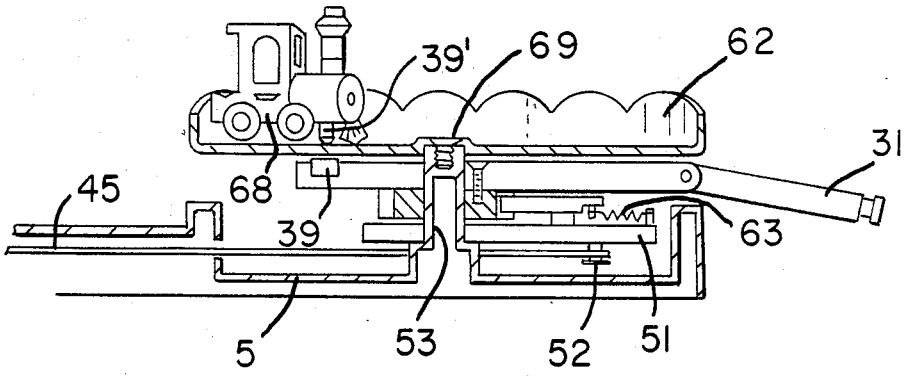
Figure 6B:
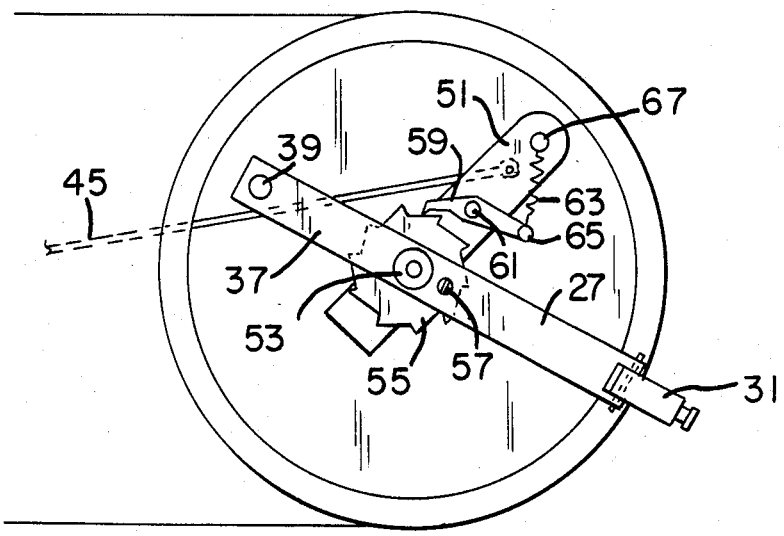

Referring now to FIGS. 5, *6a* and *6b* there is shown a second embodiment of a driving mechanism in accordance with the present invention for driving an object at a remote location. In accordance with this embodiment, a ninety degree sector 41 is secured at one apex 43 thereof to the steering wheel shaft 3. A rigid wire 45 is secured at a further apex 47 to the sector 41. The path of travel of the sector 41 is limited to approximately ninety degrees in view of the wall 49 in the base 5. However, other appropriate stop mechanisms to limit the path of travel, as desired, could be utilized. The other end of the rigid wire 45 is secured via post 52 to a ratchet arm 51 which is rotatably secured to the center post 53 which is integrally molded with the base 5. A ratchet wheel 55 is rotatable about the post 53 and the drive arm 27 is secured to the ratchet wheel 55 by means of a screw 57 and the post 53 about which it is positioned to travel along with the ratchet 55. A pawl 59 is pivotally secured in the ratchet arm 51 by means of a pivot 61, the forward end of the pawl being biased against the teeth of the ratchet 55 by means of a pawl spring 63 which is secured to the end of the pawl remote from the ratchet at securing point 65. The other end of the spring 63 is secured to the ratchet arm 51 at securing point 67 thereon.

In operation, a ninety degree rotation of the sector 41 by rotation of the steering wheel 1 will cause the rigid wire 45 to be pulled toward the steering wheel due to the clockwise rotation of the sector 41 and cause the ratchet arm 51 to be pivoted about the center post 53 in a counter-clockwise direction. This rotation will cause the pawl 59 to engage a tooth of the ratchet 55 and rotate the ratchet wheel about the post 53 in accordance with the degree of movement of the pawl 59. The drive arm 27, being secured to the ratchet 55, will rotate along with the ratchet and cause the vehicle 15 snapped onto the drive arm 31 to rotate in a circle along the same angle. When the steering wheel 1 is rotated back in the opposite direction, the rigid wire 45 will move away from the steering wheel and cause the ratchet arm 51 to move in a clockwise direction, thereby forcing the pawl 59 in a clockwise direction so that the front end of the pawl will move over the next tooth of the ratchet and be in a position to engage said tooth upon the next rotation of the steering wheel in a manner which will cause the ratchet arm 51 to again move in a counter-clockwise direction. The spring member 63 will always cause the pawl 59 to be in contact with the ratchet as is apparent.

It is readily apparent that the arm 37 and attached magnet 39, discussed hereinabove, can be used equally well with the embodiment of FIGS. 5, *6a* and *6b*.

Though the invention has been described with respect to specific preferred embodiments thereof, many variations and modifications will immediately become apparent to those skilled in the art. It is therefore the intention that the appended claims be interpreted as broadly as possible in view of the prior art to include all such variations and modifications.

What is claimed is:

1. A system for driving a toy along a predetermined path on a surface of varying height about a base member, comprising:

(a) a base member, first rotatable means mounted in said base member, (b) a toy, and (c) second means mounted in said base member and being responsive to rotation of said first rotatable means for driving said toy along said surface; said second means comprising a first rotatable arm rotatable about a pivot for rotary movement in a first plane, a second rotatable arm pivotably secured to said first arm for rotation in a second plane normal to said first plane, and (d) means for detachably coupling said toy to said second arm to cause movements of said toy corresponding to movements of said second arm in either plane, (e) said second means including a section of a disc secured to and rotatably responsive to rotation of said first rotatable means, means to limit rotation of said disc to a predetermined angle, a rigid member pivotably secured to said disc and movable in a reciprocating manner responsive to disc rotation, ratchet means including a ratchet wheel, said ratchet means being connected to said rigid member and responsive to a reciprocation cycle of said rigid member to rotate said ratchet wheel in only one direction, said first arm being rigidly secured to said ratchet wheel.

2. A system as set forth in claim 1 further including a magnet disposed on said first arm for magnetic engagement with a utilization device and rotatable with said first arm.

3. A system as set forth in claim 1 wherein said ratchet means further includes a rotatable ratchet arm secured to said rigid member and a biased pawl pivotally secured to said ratchet arm and biased against the teeth of said ratchet wheel.

4. A system for driving a toy along a predetermined path on a surface of varying height about a base member, comprising:

(a) a base member, first rotatable means mounted in said base member, (b) a toy, and (c) second means mounted in said base member and being responsive to rotation of said first rotatable means for driving said toy along said surface; said second means comprising a first rotatable arm rotatable about a pivot for rotary movement in a first plane, a second rotatable arm pivotably secured to said first arm for rotation in a second plane normal to said first plane, and (d) means for detachably coupling said toy to said second arm to cause movements of said toy corresponding to movements of said second arm in either plane, (e) further including a magnet disposed on said first arm for magnetic engagement with a utilization device and rotatable with said first arm, (f) said second means including a section of a disc secured to and rotatably responsive to rotation of said first rotatable means, means to limit rotation of said disc to a predetermined angle, a rigid member secured to said disc and movable in reciprocating manner responsive to disc rotation, ratchet means including a ratchet wheel responsive to a reciprocation cycle of said rigid member to rotate said ratchet through a predetermined angle, said first arm being secured to said ratchet means.

5. A system as set forth in claim 4 wherein said ratchet means further includes a rotatable ratchet arm secured to said rigid member and a biased pawl pivotally secured to said ratchet arm and biased against the teeth of said ratchet wheel.

6. A system for driving a toy along a predetermined path, comprising:

(a) a base member, first rotatable means mounted in said base member, (b) a toy, and (c) second means mounted in said base member and being responsive to rotation of said first rotatable means for driving said toy along said predetermined path, said second means being secured to said first rotatable means for rotation in a predetermined plane along an arc, means for limiting the rotation of the first rotatable means to a maximum predetermined distance, said second means including a rigid pivotably mounted member for substantially reciprocating movement responsive to back and forth rotation of said second means, (d) ratchet means including a ratchet wheel, said ratchet means being secured to said rigid member and responsive to a reciprocation cycle of said rigid member to rotate said ratchet wheel in only one direction through a predetermined angle, (e) and means securing said ratchet means to said toy to cause said toy to perform movements corresponding to movements of said ratchet wheel.

7. A system as set forth in claim 6 wherein said ratchet means further includes a rotatable ratchet arm secured to said rigid member and a biased pawl pivotally secured to said ratchet arm and biased against the teeth of said ratchet wheel.

8. A system as set forth in claim 6 wherein said second means is a disc in the shape of a sector of a circle, said first means is secured to one apex of said sector and said rigid member is secured to a second apex of said sector.

9. A system as set forth in claim 7 wherein said second means is a disc in the shape of a sector of a circle, said first means is secured to one apex of said sector and said rigid member is secured to a second apex of said sector.

10. A system as set forth in claim 6 wherein said rigid member is a connecting rod.

11. A system as set forth in claim 7 wherein said rigid member is a connecting rod.

12. A system as set forth in claim 8 wherein said rigid member is a connecting rod.

13. A system as set forth in claim 9 wherein said rigid member is a connecting rod.

14. A system as set forth in claim 6 further including arm means rotatable with said ratchet means and a magnet disposed on said arm means for magnetic engagement with a utilization device.

15. A system as set forth in claim 7 further including arm means rotatable with said ratchet means and a magnet disposed on said arm means for magnetic engagement with a utilization device.

16. A system as set forth in claim 8 further including arm means rotatable with said ratchet means and a magnet disposed on said arm means for magnetic engagement with a utilization device.

17. A system as set forth in claim 9 further including arm means rotatable with said ratchet means and a magnet disposed on said arm means for magnetic engagement with a utilization device.

18. A system as set forth in claim 16 further including arm means rotatable with said ratchet means and a magnet disposed on said arm means for magnetic engagement with a utilization device.

19. A system as set forth in claim 17 further including arm means rotatable with said ratchet means and a magnet disposed on said arm means for magnetic engagement with a utilization device.

* * * * *